United States Patent [19]

Yerusavage

[11] 4,276,801

[45] Jul. 7, 1981

[54] PEDAL ACTUATED MUSICAL CHORD SYSTEM

[76] Inventor: Joseph A. Yerusavage, 1425 W. 4th La., Hialeah, Fla. 33012

[21] Appl. No.: 95,228

[22] Filed: Nov. 19, 1979

[51] Int. Cl.[3] ..... G10H 1/00

[52] U.S. Cl. ..... 84/1.01; 84/DIG. 22; 84/DIG. 23

[58] Field of Search ..... 84/1.01, 1.17, 1.22, 84/1.24, DIG. 22, DIG. 23

[56] References Cited

U.S. PATENT DOCUMENTS

| | | | |
|---|---|---|---|
| 3,544,693 | 12/1970 | Tripp | 84/DIG. 22 |
| 3,624,263 | 11/1971 | Uchiyama et al. | 84/1.03 |
| 3,665,088 | 5/1972 | Brand et al. | 84/1.01 |
| 3,674,907 | 7/1972 | Derry | 84/1.01 |
| 3,725,560 | 4/1973 | Robinson et al. | 84/1.01 |
| 3,740,449 | 6/1973 | Southard | 84/1.01 |
| 3,800,060 | 3/1974 | Hallman, Jr. | 84/1.01 |
| 3,872,765 | 3/1975 | Amaya | 84/1.01 |
| 3,877,337 | 4/1975 | Obayashi et al. | 84/1.01 |
| 3,910,149 | 10/1975 | Obayashi | 84/1.01 |
| 3,962,945 | 6/1976 | Creager et al. | 84/1.01 |
| 4,100,831 | 7/1978 | Deutsch | 84/1.01 |

*Primary Examiner*—J. V. Truhe
*Assistant Examiner*—Forester W. Isen
*Attorney, Agent, or Firm*—Richard D. Weber

[57] ABSTRACT

A musical chord system includes a pedal console comprising a plurality of foot-actuated pedal switches, a chord selection switch console comprising a plurality of chord selection switches associated with said pedal switches, and diode matrix logic means interconnecting the chord selection switches with the tone generating circuitry of a conventional electronic musical instrument such as an electric organ whereby chords are sounded upon depression of the foot pedals. By adjustment of the corresponding chord selection switch, each foot pedal can be set to produce any desired one of a multiplicity of possible chords. Switches are also provided to permit the chords to be sounded on different octaves and keyboards or combinations thereof. A priority interconnect circuit prevents more than one chord from being played when two pedals are simultaneously depressed. A lower musical keyboard sustaining circuit permits the upper manual keyboard to be pulsed with alternating partial and full depression of a pedal.

13 Claims, 4 Drawing Figures

PEDAL ACTUATED MUSICAL CHORD SYSTEM

BACKGROUND OF THE INVENTION

1. FIELD OF THE INVENTION

This invention relates to electronic musical instruments that generate tones corresponding to musical notes and, more particularly, to foot-actuated pedal consoles for selectively producing chords from combinations of such notes by utilizing the existing tone generating circuitry of such electronic instruments.

2. DESCRIPTION OF THE PRIOR ART

Modern musical compositions often call for the use of electronic musical instruments to provide background accompaniment for a lead instrument, such as a guitar, horn or reed instrument. The background accompaniment typically consists of a repetitive sequence of chords or combinations of musical notes played on an electronic instrument such as an electronic organ.

Conventional electronic circuitry exists which permits an unskilled musician to provide a chord accompaniment to a melody. A system widely used on electronic organs permits the generation of musical chords when certain "root" note keys are depressed on a manual keyboard. Another system described in Craegar et al, U.S. Pat. No. 3,962,945, comprises a remote foot-actuated pedal console that interfaces with traditional electronic organ circuitry to selectively generate chords or note combinations upon depression of pedals. This latter arrangement offers the advantage that the lead musician himself can play the chord accompaniment with his feet while leaving his hands free to play the lead instrument.

Such existing chord composing systems suffer the disadvantage that depression of a particular key or pedal results in the generation of a single preset chord, and no means exists to vary the chord or note combination produced by depression of that key or pedal. Thus, although a particular background accompaniment may consist of a repetition of only three or four chords, the musician must know the location of and select from all available chord producing keys or pedals. In the Craegar arrangement, for example, the three or four chords must be repetitively selected from among 65 pedals arranged in five rows of 13 columns each—an arduous task for a musician playing a lead melody on another instrument with his hands.

SUMMARY OF THE INVENTION

The above and other advantages of existing electronic instrument chord generating systems are overcome by the present invention which comprises a pedal console having a plurality of foot-actuated pedal switches, a switch console having a plurality of chord selection switches each respectively associated with a pedal switch, and logic circuitry means interconnecting the chord selection switch output terminals with the existing tone generating circuitry of a conventional electronic musical instrument. By appropriate setting of the chord selector switch connected to a given pedal switch, the associated pedal can be programmed to produce any chord desired. The invention thus permits the musician to vary the musical response produced by depression of a set of pedals to simplify the task of providing chord accompaniment for a particular musical composition.

A musical instrument often used to provide chord accompaniment in modern musical performances is the electric organ. Conventional electric organs are usually provided with two keyboards, commonly known as the "upper manual" and "lower manual", and in addition usually include a pedal board and a foot-actuated sound volume control. The typical organ further includes "stops" which permit selection of various tone qualities for the manuals and pedal board. The pedal actuated chord system of the present invention permits a musician to fully utilize the conventional electric organ in a simplified way that requires little concentration and leaves his hands and mind free to exercise his talents on the lead instrument.

In the embodiment of the invention described herebelow, a pedal board and a switch console are provided as accessories for a conventional electronic musical instrument such as an electric organ. The pedal board includes a plurality of pedals, for example twelve, although any desired number may be used. The depression of each pedal actuates an on/off switch that is electrically connected to a selected input terminal of a diode matrix logic circuit, or other suitable logic/gate arrangement, which in turn actuates the existing tone generating circuitry of the associated electronic musical instrument to produce the desired chord. The electrical connection between the pedal on/off switches and the input terminals of the logic circuitry may be selectively varied by means of the switching console to permit selection of which chord will be sounded upon depression of a particular pedal. The switch console comprises a plurality of chord selection switches associated with the pedal switches, each selection switch being manually settable by the musician. The switch console embodiment described herein utilizes 12 two-deck, 24-position rotary switches, one for each pedal, thereby permitting each pedal to sound any selected one of 48 possible chords.

To provide flexibility and to permit greater utilization of the characteristics of a conventional electric organ, the described embodiment interfaces the output of the logic circuitry with the tone generating circuitry of more than one keyboard and more than one octave on a single keyboard of the organ. Furthermore, keyboard and octave selection on/off switches are provided to permit the musician to select the keyboards and/or octaves on which the selected chords will be played. For example, in a typical embodiment chords can be played on the upper keyboard first octave, upper keyboard second octave and/or the lower keyboard. Keyboard/octave switches which affect all pedals can be preset to determine which keyboard or octave will sound, or the pedal switching arrangement can be modified to give this control on a per pedal basis. The illustrative embodiment shows a foot-actuated keyboard-/octave selection arrangement in which chords can be played on the lower keyboard continuously while being "pulsed" on the upper keyboard. This lower keyboard sustain feature is provided by the addition of a further switch to each of the pedals. Fully depressing a pedal actuates both upper and lower keyboard chords, while partially releasing the pedal stops the upper keyboard chords but continues the lower keyboard chords until the pedal is fully released.

It is accordingly, a first object of the present invention to provide a pedal-actuated musical chord system in the form of an accessory for conventional electronic musical instruments such as electric organs and which interfaces with the existing tone generating circuitry of conventional electronic musical instruments.

It is another object of the invention to provide a pedal-actuated musical chord system as described in which the musical chord produced upon depression of any pedal can be quickly changed to a selected one of a plurality of chords independently of the other pedal chord settings.

It is a further object of the invention to provide a pedal-actuated musical chord system as described wherein the musical chord produced upon depression of any pedal can selectively be varied to include a selected one or more keyboard(s) and/or octave(s).

The above and other objects and advantages of the invention will become more readily apparent upon reference to the detailed description of the preferred embodiment below and to the accompanying drawings.

DESCRIPTION OF THE PREFERRED EMBODIMENT

Figure 1:
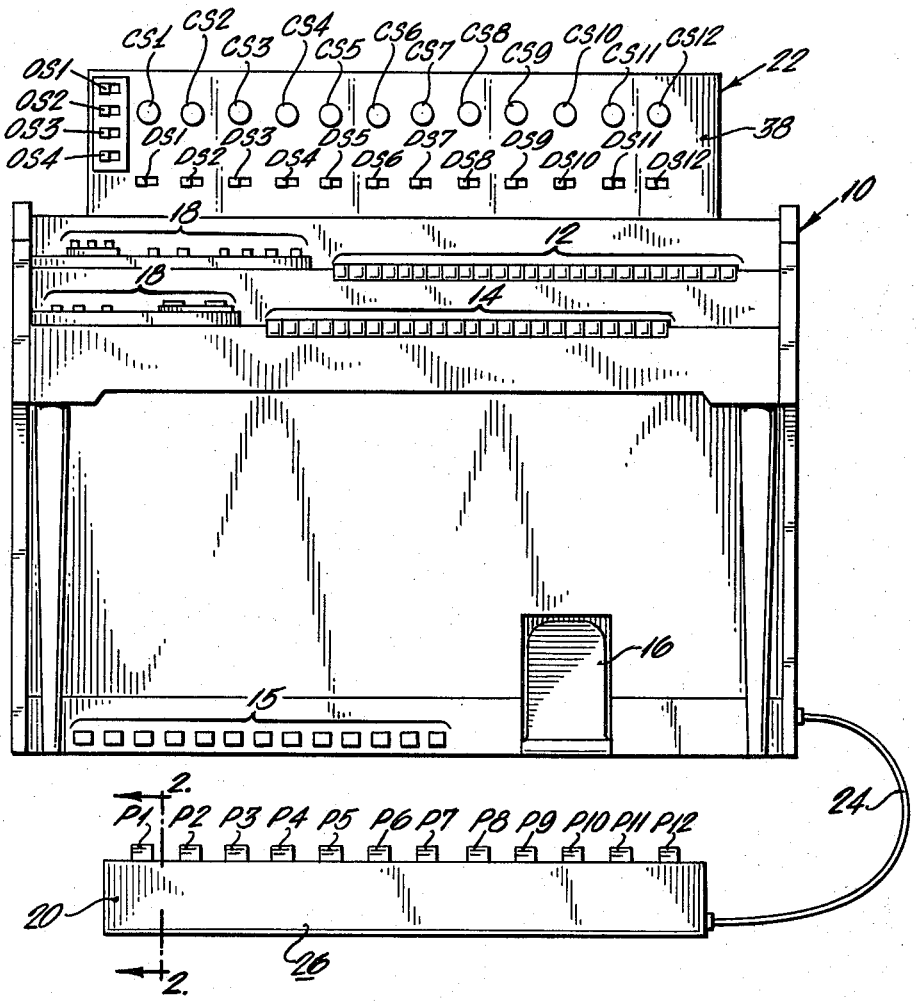
FIG. 1 is a front elevational view of the switching console and pedal board of a preferred embodiment of the invention shown in association with a conventional electric organ.

Referring to the drawings, a pedal actuated musical chord system in accordance with the present invention is illustrated as applied to a conventional electric organ 10. As shown in FIG. 1, organ 10 includes upper and lower keyboards or manuals 12 and 14, pedal board 15, sound volume control pedal 16, and various stops 18 which control keyboard and pedal board tone quality. The organ 10 produces musical tones on either of keyboards 12 or 14, or the pedal board 15 when the keys or pedals corresponding to those tones are depressed, thereby closing key or pedal switches and actuating the connected tone circuits.

The components of the present invention include a pedal console 20 and a switch console 22 which are electrically connected by conductors contained in a trunk line 24. As described in detail below, the components of the present invention interface with the tone generator circuitry of the organ 10 by means of logic circuitry which causes simultaneous closing of predetermined combinations of organ switches in response to depression of the foot pedals of the pedal console.

The logic circuitry has a plurality of input terminals, each of which upon activation produces a particular chord through simultaneous closing of certain key switches of the existing organ circuitry. Activation of the logic circuitry is brought about by closure of pedal-actuated switches located in the pedal console 20 which delivers electrical power to one of the input terminals of the logic circuitry. The determination of which input terminal will receive the electrical power in response to closure of a particular pedal-actuated switch is dependent on the settings of chord selection switches located in switch console 22 which serves to selectively connect the electrical outputs of the pedal console 20 with the input terminals of the logic circuitry.

Figure 2:
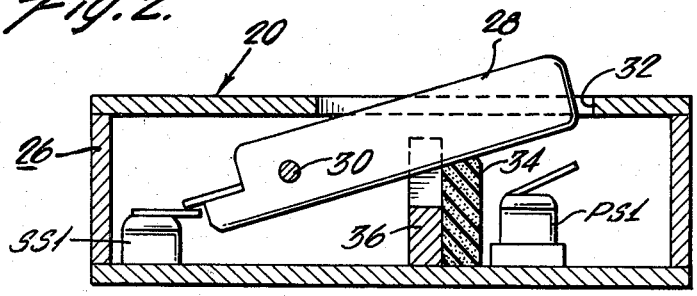
FIG. 2 is an enlarged sectional view taken along line 2—2 of FIG. 1 showing details of the pedal console construction.

As shown in FIG. 2, the pedal console 20 comprises a housing 26 containing a plurality of pedals P1–P12, each of which is mounted near one end thereof on a horizontal pin 30 for independent pivotal movement. In the illustrated example, twelve pedals are arranged in a parallel side-by-side array, though any number and arrangement of pedals can be used. The pedals protrude outward of housing 26 through apertures 32 spaced along the upper surface of the housing.

A compression spring 34 comprising a piece of resilient foam rubber disposed between the base of housing 26 and the underside of pedal 28 serves to bias the pedal toward a raised position. A stop 36 on the base of housing 26 limits the downward pedal movement. The complete depression of pedal 28 serves to close a normally open pedal switch PS1 located beneath the toe of the pedal and to allow the opening of a normally closed sustain switch SS1 located adjacent the heel of the pedal. The partial release of pedal 28 permits pedal switch PS1 to open but retains sustain switch SS1 in a closed position to provide a sustaining effect as described below.

The trunk line 24 connecting pedal console 20 to the switch console 22 and organ 10 may be of such a length as to permit pedal console 20 to be operated remotely from the organ. On the other hand, the pedal console housing could be constructed so that it can be used in front of organ 10 by a musician seated on the organ bench without interfering with the pedal board 15.

The switch console 22 includes a front panel 38 on which are mounted 12 chord selection switches CS1–CS12, each of which is connected with one of the twelve pedal switches PS1–PS12. In the present embodiment, the chord selection switches are 24-position, two-deck rotary switches. Twelve selector switches DS1–12 are located below the rotary switches CS1–12 and serve to direct the output from the pedal switches to either the upper or lower deck of the rotary switches.

The rotary switches each have 48 output terminals, 24 on the upper or "A" deck and 24 on the lower or "B" deck. Each of these outputs serves as an input to the logic circuitry that interfaces with the tone generating circuitry of organ 10. Thus, for each pedal 28 of pedal console 20 the corresponding chord selection switch can be manually set by the user to any one of 48 possible positions. Since each position of selector switch CS1 corresponds to a different input to the logic circuitry of the chord selector, any one of 48 possible chords can be played by each pedal.

Figure 3:
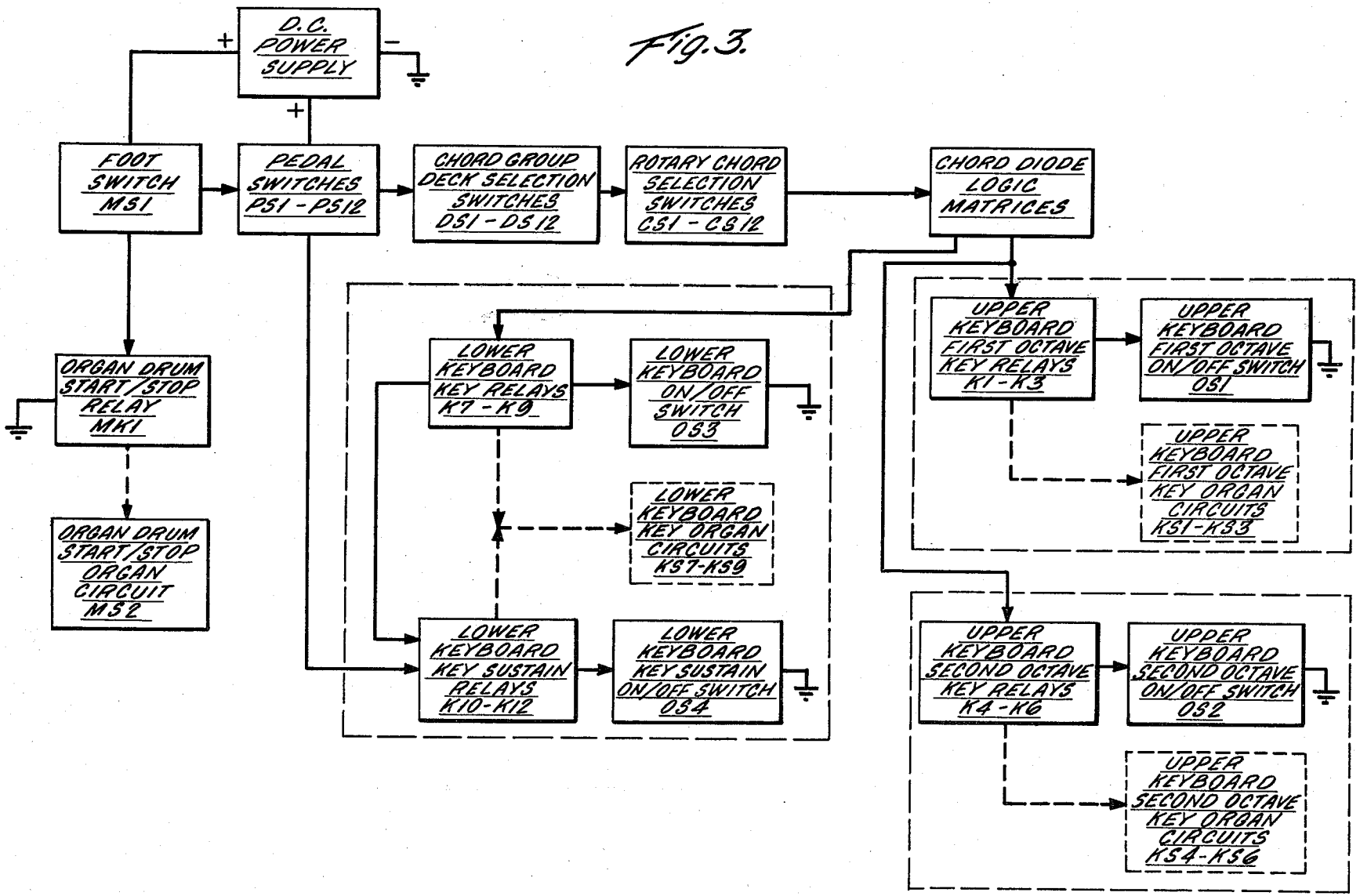
FIG. 3 is a block diagram of the electronic circuitry of the preferred embodiment of the invention.

Keyboard/octave switches OS1–OS4 located at the left side of the switch console front panel 38 control which keyboard(s) or octave(s) of the organ 10 will sound when the pedals are depressed. Switch OS1 controls a first octave of the upper keyboard, OS2 the second octave of the upper keyboard, OS3 the lower keyboard and OS4 the sustain feature utilizing the lower keyboard. A more detailed understanding of the functioning of the logic circuitry and switching network of the illustrative embodiment can be gained from the block diagram shown in FIG. 3 and the partial schematic diagram shown in FIG. 4. Portions of the circuitry are omitted from the schematic of FIG. 4 to simplify the presentation and to permit a larger scale view of the illustrated portions of the circuit.

Figure 4:
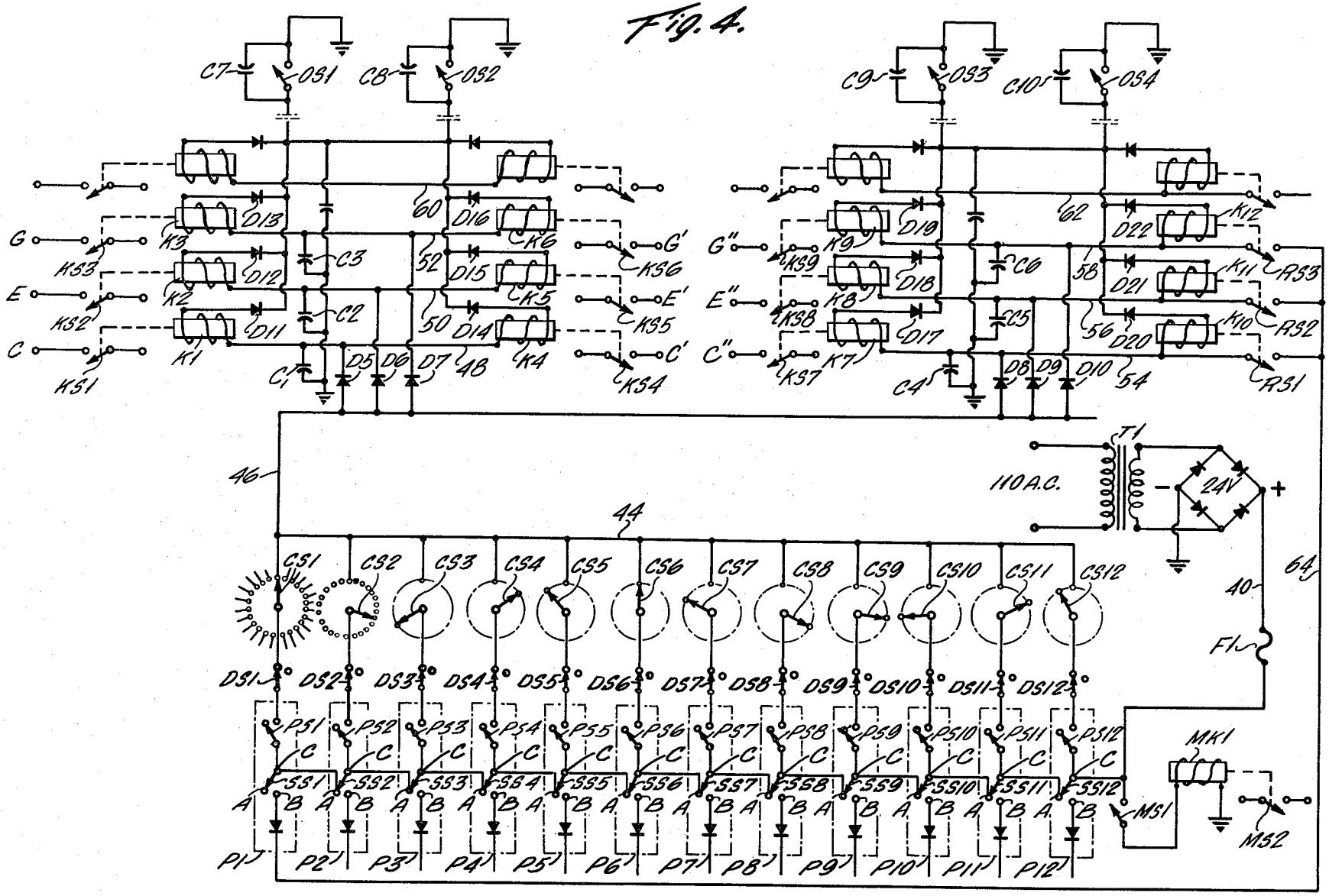
FIG. 4 is a partial schematic circuit diagram, illustrating a portion of the circuitry of the preferred embodiment.

Power for the chord selector operation is supplied by any conventional DC power supply. For example, as shown in FIG. 4, the power supply may comprise a transformer T1 whose primary coil is connected to a standard 110 volt AC power supply and whose secondary coil is connected to a full wave diode bridge rectifier to provide 24-volt DC power input to the pedal switches. The positive side of the 24-volt DC power supply is connected by conductor 40, which passes through fuse F1, to one side of each of pedal switches PS1-PS12 and each of sustaining switches SS1-SS12 through a connection system that serves as an electrical priority interlock so that only one pedal switch and sustaining switch pair can be actuated at one time, i.e. two chords cannot be played at once. The interlock circuitry of FIG. 4 gives priority to the right hand pedal of a pair or group of pedals which are simultaneously depressed.

For references purposes, the 12 pedals illustrated in FIG. 4 are numbered P1 through P12 from left to right. The common center terminal C of switches PS 12 and SS 12 of pedal No. 12 is connected to the positive terminal of the power supply directly through conductor 40. The common center terminal C of switches PS 11 and SS 11 of pedal No. 11 is connected to the positive side of the power supply through terminals A and C of switch SS 12 of pedal No. 12 and the conductor 40. The common center terminal C of switches PS 10 and SS 10 of pedal No. 10 is connected to the positive side of the power supply through terminals A and C of switch SS 11 of pedal No. 11 and through terminals A and C of switch SS 12 of pedal No. 12 and then through conductor 40. Likewise, each of the center terminals C of the pedals Nos. 1-9 are connected through the terminals A and C of the sustaining switches of all the proceeding pedals to the right of it and through conductor 40. When any pedal No. 1-12 is depressed to play a chord the corresponding sustaining switch is actuated to provide connection between terminals B and C of that switch and thereby break the electrical connection between terminals A and C of that switch. Thus, depressing a pedal locks out all electrical connections to the power supply of pedals to the left of the depressed pedal.

When any one of pedals P1-P12 is depressed, the associated pedal switch PS1-PS12 and sustaining switch SS1-SS12 are closed. This provides electrical connection between the positive side of the power source and deck selection switches DS1-DS12 and rotary chord selection switches CS1-CS12. It also provides electrical connection of the buss conductor 64 to the power supply.

Each of switches CS1-CS12 has 24 positions which are referenced Nos. 1 through 24 beginning at the 12 o'clock position and continuing clockwise around the dials. The 48 output terminals of each two-deck, 24-position rotary switch are connected to 48 input terminals of the chord selector logic circuitry. Since each input terminal to the chord selector logic is preset to actuate a different chord or note combination on the electronic organ circuitry, the user sets the switches DS1-DS12 and CS1-CS12 to select the desired one of 48 available chords he wants to sound for each of the pedals. When a pedal is depressed the positive side of the power supply will be connected to the user set chord selector logic input terminal and the desired tone generation circuits will be activated.

Common logic circuitry input terminals are connected by means of busses to the identically numbered output terminals of the two decks of chord selector switches CS1-CS12. Accordingly, if all switches DS1-DS12 and CS1-CS12 were to be set to the same position, pedals Nos. 1-12 would all play the same chord when depressed. As shown in FIG. 4, all deck A position #1 settings of switches CS1-CS12 are connected together by a common bus conductor 44. Similarly, although not shown, each of the other 47 switch settings are interconnected to produce the same chord on the same number setting for any selected pedal. For example, if the #1 A deck setting produces a C major chord for each pedal, the #2A deck setting might produce a C minor chord, #3 a C augmented chord, etc. Other switching arrangements can be substituted for switches DS1-DS12 and CS1-CS12 to perform the same function of channeling the output of pedal switches PS1-PS12 to logic input terminals. Also, the selection of available logic input terminals to which the outputs of switches PS1-PS12 are channelled do not have to be the same. However, utilizing common chord selections for each chord selection switching network provides the most flexibility and simplifies the circuitry.

The logic that connects the output terminals of switches CS1-CS12 to the activation of combinations of key switches on the keyboards of organ 10 can be digital logic circuitry, i.e. AND, NAND, OR and NOR gates, or can be diode matrix logic comprising direct matrix wiring of input terminals to components, such as electromagnetic relays, that activate the relevant key switches. The logic circuitry of the illustrated example comprises chord diode logic matrices.

To illustrate the connections and components constituting such diode logic, FIG. 4 shows the schematic circuitry for a C-major chord selection for pedal P1 which is obtained by setting deck selector switch DS1 to the "A" deck setting, and chord selection switch CS1 to the #1 setting. Full depression of pedal P1 closes pedal switch PS1 which connects the positive voltage from contact C of switch SS1 to a conductor buss 46 through switches DS1 and CS1. The application of positive voltage to the anode electrodes of diodes D5-D10 renders them forward biased for conduction of the positive voltage to conductors 48, 50 and 52 of the upper keyboard chord logic circuitry and to conductors 54, 56 and 58 of the lower keyboard logic circuitry. This likewise applies the positive voltage to the anode electrodes of diodes D11-D22 as shown.

Keyboard/octave switch OS1 serves when closed to connect the cathode electrode of diodes D11-D13 to electrical ground. When switch OS1 is closed, current flows through gates such as electromagnetic relays K1-K3 which close key switches KS1-KS3 which in turn actuate the tone generation circuitry of the first octave of the upper keyboard to produce a chord comprising the notes C, E and G. Switches KS1-KS3 can be activated directly by relays K1-K3 as shown, or relays K1-K3 can be used to close auxiliary switches (not shown) wired in parallel with the switches KS1-KS3.

Likewise, when keyboard/octave switch OS2 is closed, current flows through relays K4-K6 which close key switches KS4-KS6 of notes on the second octave of the upper keyboard to produce the notes C', E' and G', as shown in FIG. 4. And, when keyboard/octave switch OS3 is closed, current flows through relays K7-K9 which closes key switches KS7-KS9 of keys on the lower manual keyboard of organ 10 corresponding to notes C'', E'' and G'', as shown in FIG. 4.

Similar circuits are provided for every other input terminal of the chord selector logic matrices. For example, consider position No. 2, deck A of switch CS1 to be a C minor chord. A common buss conductor (not shown) connects all positions Nos. 2, deck A for switches CS1–CS12. This buss then supplies positive voltage biasing to the anode electrodes of diodes (not shown) whose cathodes are connected to buss conductors 48 and 54 to produce the C, C′ and C″ notes, to buss conductors 52 and 58 to produce the G, G′ and G″ notes, and to buss conductors 60 and 62 to produce the E flat, E′ flat, and E″ flat notes. Although not shown, the full circuit will comprise at least twelve busses such as 60 and 62 for each keyboard to supply the necessary key switch actuation.

When keyboard/octave switch OS1 is closed, chords will be sounded in the first octave of the upper keyboard. When switch OS2 is closed, the chords will be sounded in the second octave of the upper keyboard. And, when switch OS3 is closed, chords will be sounded in the lower keyboard. One, any two, or all of switches OS1–OS3 can be closed as desired to change the qualities of the sounded chords.

The diodes' function in the matrix is to keep the direction of current flow in only one direction along the paths in which the diodes are placed. In the illustrative embodiment, every output terminal chord setting on switch CS1 that includes a C, for example, to be played on the first register of the upper keyboard will be connected from the respective output terminal on CS1 to a buss conductor connecting similar output terminals of switches CS2–CS12. The diode connections serve as columns in the upper keyboard and lower keyboard matrices electrically connecting the respective output terminal busses to the busses such as conductor 48 which form the matrix rows connecting to the key switch actuating relays. Without the use of diodes, depressing pedal P1 with switches DS1 and CS1 closed would close all key switches of notes contained in chords having C's, E's or G's in them.

Capacitors C1–C6 of 0.1 microfarad are used to connect the busses 48–62 to ground to eliminate electrical spikes and other variations in the DC voltage. Such capacitors have no effect on the DC voltage in the busses, acting as open circuits to the DC signal. Similarly, capacitors C7–C10 are connected across switches OS1–OS4 for the same purpose.

The closing of keyboard/octave selection switch OS4 activates the lower keyboard chord sustaining mode of the invention. When one of the twelve pedals P1–P12 is depressed, the corresponding sustaining switch SS1–SS12 is closed thereby connecting buss 64 to the positive side of the power source. When switch OS4 is closed and pedal P1 is depressed with the chord selection switches set as shown in FIG. 4, current flows through relays K7–K9 to close key switches KS7–KS9 which sound the lower keyboard notes C″, E″, and G″. However, locking relays K10–K12 are also energized, and act to close relay sustain switches RS1–RS3. Partial release of pedal P1, opens switch PS1 but keeps switch SS1 closed. Chords sounded on the upper keyboard are thus cut off by the partial release of the pedal, but relays K7–K9 which close key switches on the lower keyboard are still energized, being connected to the positive terminal of the power supply through closed switches RS1–RS3 and switch SS1. Key switches KS7–KS9 remain closed until pedal P1 is completely released, thereby opening sustain switch SS1. If the sustain mode is not desired, switch OS4 is opened, preventing energization of relays K10–K12 and the closing of switches RS1–RS3. By manipulating a pedal alternatingly from a fully depressed position to a partially depressed position, the pedal switch (PS1–PS12) will alternatingly open and close, but the sustain switch (SS1–SS12) will remain closed to sustain the chord sounded on the lower keyboard and pulse the chords on the first and second registers of the upper keyboard.

For organs producing tones by the use of an air compressor or drum, a foot-actuated on/off switch MS1 can be located on the foot pedal console 20 adjacent to one of the end peddles. The switch MS1 is preferably of the type that turns on with one depression and turns off with a second depression. Closing MS1 actuates relay MK1 which closes drum switch MS2 on organ 10. The foot-actuated switch permits the drum to be turned off by the performer when the chord accompaniment is not needed and turned back on when required.

The pedal-actuated musical chord system invention permits a musician to provide musical accompaniment in the form of chords played on an electronic musical instrument by simple depression of a few foot pedals on a pedal console that can be used remotely from the electronic instrument. The chord responses obtained by depression of each pedal can be selected from a multiplicity of possible chords. For example, to play a chord accompaniment to a guitar melody requiring C major, F major, E major, and D minor chords, the guitarist need only use four foot pedals. The chord selection switches could be set so that pedal P1 will play a C major chord, pedal P2 an F major chord, pedal P3 an E major chord, and pedal P4 a D minor chord. Thus, while playing a guitar with both hands, a musician can with one foot and with little training provide his own accompaniment with the full range of instrument sounds available through the stop settings of an electronic organ. The musician further can choose to provide chords from the lower keyboard, upper keyboard first octave, or upper keyboard second octave in any desired combination. As an additional option, the sustain feature can be employed to permit interruption of the upper keyboard chord while sustaining the chord on the lower keyboard.

Manifestly, changes in details of construction can be effected by those skilled in the art without departing from the spirit and scope of the invention.

I claim:

1. Apparatus for generating selected chords in response to foot pedal actuation for use with an electronic musical instrument having note generating means, comprising logic means associated with said note generating means, said logic means having a plurality of input terminals, each of said input terminals producing a chord containing preselected notes upon energization thereof; a plurality of foot pedals; first switch means associated respectively with each of said foot pedals and actuated by depression thereof for energizing said logic means; and second switch means associated respectively with each of said foot pedals for permitting selection of which one of said logic means input terminals said first switch means shall energize; whereby a user can select which one of a plurality of chords will be generated upon depression of each of said pedals.

2. The apparatus of claim 1, further comprising a priority circuit suppressing the actuation of all but one of said first switch means in accordance with a predetermined priority scheme, whereby upon the simultaneous depression of more than one foot pedal only one chord will be generated.

3. The apparatus of claim 1, wherein energization of each of said input terminals of said logic means produces a chord comprising a plurality of secondary chords each comprising preselected notes, each one of said secondary chords being made up of notes of different pitch or quality, and third switching means for selectively controlling which secondary chord or secondary chord combination will be played upon depression of a given pedal.

4. The apparatus of claim 3, with sustaining mode circuitry for selectively permitting one secondary chord to be sustained longer than the other secondary chords.

5. The apparatus of claim 4, wherein said sustaining mode circuitry includes fourth switch means associated with each of said pedals which is operable upon partial depression of said pedals to continue energization of the note generating means of the notes of the secondary chord to be sustained.

6. The apparatus of claim 1, including a foot actuated on/off switch.

7. The apparatus of claim 1, wherein said logic means comprises a diode logic matrix.

8. The apparatus of claim 7, wherein the note generating means of said instrument are energized by relays.

9. The apparatus of claim 1, wherein said second switching means comprises a two-deck rotary switch.

10. The apparatus of claim 3, including shunt capacitors around said third switching means.

11. Apparatus for generating selected chords in response to foot pedal actuation for use with an electronic organ having note generating means operably connected with and having tonal qualities selectable on upper and lower keyboards, comprising, logic means associated with said note generating means, said logic means having a plurality of input terminals, each of said input terminals producing a chord containing preselected notes upon energization thereof, means permitting selection of the tonal qualities of said chords produced upon energization of said input terminals by selective inclusion in said chords of notes from either one or both of said upper and lower keyboards, a plurality of foot pedals, first switch means associated respectively with each of said foot pedals and actuated by depression thereof for energizing said logic means, and second switch means associated respectively with each of said foot pedals for permitting selection of which one of said logic means input terminals said first switch means shall energize, whereby a user can select which one of a plurality of chords will be generated upon depression of each of said pedals.

12. Apparatus as claimed in claim 11, including switch means associated with each of said foot pedals permitting the selective sustaining of the notes of a chord played by the pedal from one keyboard longer than notes of the chord from the other keyboard when the chord comprises notes from both said keyboards.

13. The invention as claimed in claim 11 wherein said means permitting selection of the tonal qualities of said chords includes switch means permitting selection of the notes of said chords from either or both the upper and lower octaves of said upper keyboard as well as from said lower keyboard.

* * * * *